US007563494B2

(12) United States Patent
Nagashima et al.

(10) Patent No.: US 7,563,494 B2
(45) Date of Patent: Jul. 21, 2009

(54) INK-JET RECORDING MATERIAL

(75) Inventors: Takeshi Nagashima, Chiyoda-ku (JP); Satoshi Kaneko, Chiyoda-ku (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 1380 days.

(21) Appl. No.: 10/073,213

(22) Filed: Feb. 13, 2002

(65) Prior Publication Data

US 2002/0182380 A1 Dec. 5, 2002

(30) Foreign Application Priority Data

Feb. 16, 2001 (JP) ..... 2001/040744

(51) Int. Cl.
*B41M 5/40* (2006.01)

(52) U.S. Cl. ..... 428/32.19; 428/32.22; 428/32.24; 428/32.25; 428/32.28; 428/32.35

(58) Field of Classification Search ..... 428/32.22, 428/32.24, 32.25, 32.34, 32.19, 32.28, 32.35
See application file for complete search history.

(56) References Cited

U.S. PATENT DOCUMENTS 5,275,867 A * 1/1994 Misuda et al. ..... 428/32.25
6,089,704 A * 7/2000 Burns et al. ..... 347/105
6,096,469 A * 8/2000 Anderson et al. ..... 430/119
6,214,458 B1 * 4/2001 Kobayashi et al. ..... 428/332
6,310,133 B1 * 10/2001 Katashima et al. ..... 524/496
6,432,550 B1 8/2002 Ohbayashi et al.
6,436,515 B1 * 8/2002 Ohbayashi et al. ..... 428/32.33
6,495,243 B1 * 12/2002 Malhotra ..... 428/195
6,503,606 B1 * 1/2003 Sato et al. ..... 428/206
6,551,695 B2 * 4/2003 Kaneko et al. ..... 428/195
2001/0016249 A1 * 8/2001 Kitamura et al. ..... 428/195
2001/0053435 A1 * 12/2001 Ishii et al. ..... 428/195
2002/0008753 A1 * 1/2002 Suzuki et al. ..... 347/106
2002/0018055 A1 * 2/2002 Smith et al. ..... 345/204

FOREIGN PATENT DOCUMENTS

JP 11-208099 * 8/1999

OTHER PUBLICATIONS

Merriam-Webster OnLine. Opaque.*
Meriam-Webster OnLine. Translucent.*
Japanese Industrial Standard, "Testing for Opacity of Paper" JIS-P-8138-1976 (Reaffirmed 1984), Japanese Standards Association 1988.

* cited by examiner

*Primary Examiner*—Betelhem Shewareged
(74) *Attorney, Agent, or Firm*—Paul E. White; Manelli Denison & Selter PLLC

(57) ABSTRACT

There is disclosed an ink-jet recording material which comprises a light transmitting support, at least one ink-receptive layer provided on one surface of the support and at least one back-coating layer provided on the opposite surface of the support, wherein at least one of the back-coating layers contains inorganic fine particles having an average particle size of a primary particle of 5 to 50 nm and a binder, and a void ratio of the layer is 70% by volume or less.

28 Claims, No Drawings

INK-JET RECORDING MATERIAL

BACKGROUND OF THE INVENTION

1. Field of the Invention

The present invention relates to an ink-jet recording material using a light transmitting support, particularly to an ink-jet recording material for a medical field that is excellent in ink-absorption property, printing density, light transmitting property and printing paper feeding and conveying property, and causes no transfer of a printed image to a back surface of another recording material (hereinafter referred to as "back transcription").

2. Prior Art

A silver halide photographic light-sensitive material, which has been generally used in a medical field, involves problems that a silver salt is expensive, and a wet process such as a developing treatment, etc. is required, so that a waste liquor must be treated. Also, in a heat-sensitive transfer system, there is a problem of peeling of ink, while in a sublimation system, there is a problem that a printing density is low. To the contrary, an ink-jet recording material employs a completely dry recording system and there are merits that a noise is little, change in a recording pattern is easy and an image can be formed accurately and rapidly, and the like.

As an ink-jet recording material to be used for an ink-jet recording method, it has been known a recording material which comprises an ink-receptive layer made of a hydrophilic polymer or a porous ink-receptive layer containing a pigment such as amorphous silica, etc. and a water-soluble binder, being provided on a support such as a usual paper or the so-called ink-jet recording sheet.

There have been proposed recording materials obtained by coating a hydrophilic polymer such as starch, polyvinyl alcohol, etc. onto a support as disclosed in, for example, Japanese Provisional Patent Publications No. 80489/1981, No. 174381/1984, No. 220750/1985, No. 32788/1986, No. 160875/1988, No. 69388/1991, and the like.

There have been also proposed recording materials obtained by coating a silicon-containing pigment such as silica, etc., or an alumina sol with an aqueous binder onto a paper support as disclosed in, for example, Japanese Provisional Patent Publications No. 51583/1980, No. 157/1981, No. 107879/1982, No. 107880/1982, No. 230787/1984, No. 160277/1987, No. 184879/1987, No. 183382/1987, No. 11877/1989, No. 21508/1991, No. 67986/1992, and the like.

Further, there have been disclosed recording materials using synthetic silica fine particles prepared by a gas phase process (hereinafter referred to as "fumed silica") in Japanese Patent Publication No. 56552/1991, Japanese Provisional Patent Publications No. 188287/1990, No. 132728/1996, No. 81064/1998, No. 119423/1998, No. 175365/1998, No. 193776/1998, No. 203006/ 1998, No. 217601/1998, No. 20300/1999, No. 20306/1999, No. 34481/1999, and the like.

On the other hand, it has been investigated to prepare a transparent recording sheet for an OHP, etc., or a film for medical use by an ink-jet recording system. These recording sheets are important to have an ink-absorption property, water-resistant property and light transmitting property. In particular, it is important to prevent from causing the problems of blocking or back transcription of an image when printing is carried out continuously and printed papers are piled up.

In Japanese provisional Patent Publication No. 276789/1995, a recording material with a high ink-absorption property and high transparency is disclosed, which comprises a transparent support and provided thereon, a colorant-receptive layer in which a weight ratio of silica fine particles having an average particle size of the primary particles being 10 nm or less and a water soluble polymer is 1.5:1 to 10:1. However, there is no description regarding a blocking property or a prevention against blocking and back transcription of an image.

In Japanese Provisional Patent Publications No. 174994/1996 and No. 263043/1997, there are proposals to prevent from blocking by adding fine particles or a filler which is/are projected to the surface of an ink-receptive layer. However, these ink-jet recording materials involve problems in glossiness, image sharpness and touched feeling, and an improvement in the ink-receptive layer alone is insufficient to overcome these problems. In Japanese Provisional Patent Publication No. 234944/1997, a proposal to overcome problems in blocking and back transcription of ink has been disclosed by making an absorption property about water and an alcohol having a high boiling point of an opposed surface of an ink-receptive layer a specific value or more. However, its measure to overcome the problem of back transcription of ink was insufficient.

SUMMARY OF THE INVENTION

An object of the present invention is to provide an ink-jet recording material which causes no transfer of a printed image to a back surface of another recording material, and excellent in ink-absorption property, printing density, printing paper feeding and conveying property and light transmittance.

The present inventors have intensively studied to solve the above-mentioned problems, and as a result, they have found that back transcription of an image has been caused by two kinds of different mechanisms. That is, one of which is caused by a mechanism in which ink of a printed image is directly in contact with a back surface of another recording material to cause the back transcription (hereinafter referred to as "back transcription of ink"), and the other is caused by a mechanism in which water or an organic solvent contained in ink of a printed image is adsorbed by a back surface of another recording material to cause a partially transparent or turbid problem of a back coating layer (hereinafter referred to as "back transcription of a solvent"). In the case of using a transparent recording material, occurrence of a partially transparent or turbid problem of the back coating layer by the latter mechanism becomes a particularly significant problem. Thus, the present inventors have investigated to solve the above problems. As a result, they have found that an ink-jet recording material excellent in ink-absorption property, water resistance and light transmittance, and capable of preventing from back transcription could be obtained by the following means to accomplish the present invention.

(1) An ink-jet recording material of the present invention comprises a light transmitting support, at least one ink-receptive layer provided on one surface of the support and at least one back-coating layer provided on the opposite surface of the support, wherein at least one of the back-coating layers contains inorganic fine particles having an average particle size of a primary particle of 5 to 50 nm and a binder, and a void ratio of the layer is 70% by volume or less.

(2) The ink-jet recording material according to the above (1), wherein the ink-receptive layer contains inorganic fine particles having an average particle size of a primary particle of 5 to 30 nm and a hydrophilic binder.

(3) The ink-jet recording material according to the above (1), wherein the ink-receptive layer contains at least one of an inorganic pigment and an organic pigment having an average particle size of 0.5 to 10 μm.

(4) The ink-jet recording material according to the above (1), wherein the ink-receptive layer comprises two or more layers, and an ink-receptive layer (A) near to the light transmitting support contains fumed silica having an average particle size of a primary particle of 10 to 30 nm and a hydrophilic binder and an ink-receptive layer (B) far from the light transmitting support contains alumina or alumina hydrate having an average particle size of a primary particle of 5 to 30 nm and a hydrophilic binder.

(5) The ink-jet recording material according to the above (4), wherein the ink-receptive layer (B) contains at least one of an inorganic pigment and an organic pigment having an average particle size of 0.5 to 10 μm in an amount of 0.01 to 1 g/m$^2$.

(6) The ink-jet recording material according to the above (4), wherein a ratio (C) of the hydrophilic binder to the fumed silica of the ink-receptive layer (A) is 5 to 20% by weight and a ratio (D) of the hydrophilic binder to the alumina or alumina hydrate of the ink-receptive layer (B) is 6 to 22% by weight and (C) is smaller than (D).

(7) The ink-jet recording material according to the above (1), wherein the inorganic fine particles in the back coating layer are wet process silica having 5 or more silanol groups per square nm.

(8) The ink-jet recording material according to the above (7), wherein the wet process silica in the back coating layer is colloidal silica.

(9) The ink-jet recording material according to the above (1), wherein the binder in the back coating layer is polyvinyl alcohol or a modified product thereof.

(10) The ink-jet recording material according to the above (1), wherein a solid content of the back coating layer is 1 to 10 g/m$^2$.

(11) The ink-jet recording material according to the above (1), wherein the light transmitting support is a polyester film.

DESCRIPTION OF THE PREFERRED EMBODIMENTS

In the following, the present invention is described in detail.

As the light transmitting support to be used in the present invention, there may be mentioned, for example, a plastic resin film such as a polyester resin including polyethylene terephthalate (PET) and polyethylene naphthalate, a diacetate resin, a triacetate resin, a cellulose resin such as nitro cellulose and cellulose acetate, a polyolefin resin, an acrylic resin, a polycarbonate resin, polyvinyl chloride, a polyimide resin, polysulfone, polyphenylene oxide, cellophane, celluloid, etc. Especially, a film of a polyester resin is preferably used in terms of properties such as heat resistance and a production cost. A thickness of the resin film support to be used in the present invention is preferably about 50 μm to about 250 μm considering a curling property and handling.

According to the preferred embodiments of the present invention, for at least one of the ink-receptive layer coated on the light transmitting support, there are a case where it comprises a hydrophilic polymer, and optionally containing an inorganic pigment and/or an organic pigment, a cationic polymer, a hardening agent, a surfactant, etc. (hereinafter referred to as a swelling-type ink-receptive layer) and a case where it comprises a hydrophilic polymer, inorganic fine particles, preferably inorganic fine particles having an average particle size of the primary particles of 5 to 50 nm, and optionally containing a cross-linking agent, a cationic polymer, a surfactant, etc. (hereinafter referred to as a void-type ink-receptive layer). A coating solution for the ink-receptive layer is so coated that a coated layer is formed with a thickness of several tens to several hundreds of μm, and then, it is subjected to drying. In a preferred example of the production method, the ink-receptive layer coated on the light transmitting support is once cooled down in an atmosphere of 20° C. or lower, and then, dried in a drying process.

In a general comparison between the swelling-type ink-receptive layer and the void-type ink-receptive layer, the former has high glossiness, while its surface tends to have surface glare and it is inferior in ink-absorption property. Especially when it is used in a medical field, the ink-absorption property is a matter of importance since an image printed by an ink-jet recording method should sufficiently reproduce the actual material. The increased surface glare caused by a back light of the outside light is not preferred since it makes it difficult to observe an image when it is used in a back lighting system where an image is directly observed from a printed surface by irradiating light from the opposite side of the printing surface. From the above, with regard to a medical use where the back lighting system is employed, the void-type ink-receptive layer is more preferred although it has not attained a sufficient level for a practical use.

In the present invention, as the hydrophilic polymer to be used in case of the swelling-type ink-receptive layer, there may be mentioned gelatin, polyvinyl alcohol, polyvinyl pyrrolidone, polyvinyl pyridinium halide, polyacrylamide, sodium polyacrylate, starch, carboxylated starch, cation starch, dialdehyde starch, casein, ethyl cellulose, carboxymethyl cellulose, polyethylene glycol, polypropylene glycol, styrene-maleic anhydride copolymer, and modified products thereof, etc.

In the present invention, as the inorganic fine particles to be used in case of the void-type ink-receptive layer, there may be mentioned light calcium carbonate, heavy calcium carbonate, magnesium carbonate, kaoline, titanium dioxide, zinc oxide, zinc hydroxide, calcium silicate, magnesium silicate, synthesized silica, alumina, alumina hydrate, aluminum oxide, magnesium hydroxide and the like. Preferably, inorganic fine particles having an average particle size of primary particles of 5 to 30 nm is used, and fumed silica, alumina, and alumina hydrate are selected in the points of high printing density, sharp image and an inexpensive production cost. An average particle size of the inorganic fine particles is preferably small since reproducibility of a printed image is required with a high density particularly in the medical use, and it is determined in relation to an ink absorption property.

In synthesized silica, there are two types of materials, one (precipitated silica) of which is prepared by the wet process and the other (fumed silica) is prepared by the gas phase process. Usual silica fine particles mean those prepared by the wet process in many cases. As the silica prepared by the wet process, there are (1) a silica sol obtained by metathesis of sodium silicate by an acid or passing through an ion exchange resin layer; (2) a colloidal silica obtained by heating and maturing the silica sol of (1); (3) a silica gel obtained by gelling silica sol in which formation conditions thereof are changed whereby primary particles of a silica gel having a diameter of several μm to 10 μm are siloxane bonded to form three-dimensional secondary particles; and (4) a synthetic silicic acid compound mainly comprising silicic acid obtained by heating silica sol, sodium silicate, sodium aluminate, etc.

Fumed silica to be used in the present invention is also called to as the drying method silica relative to the wet type method, and it can be generally prepared by a flame hydrolysis method. More specifically, it has been generally known a method in which silicon tetrachloride is burned with hydrogen and oxygen. In this method, silanes such as methyl trichlorosilane, trichlorosilane, etc., may be used alone in place of silicon tetrachloride or in combination with silicon tetrachloride. The fumed silica is commercially available from Nippon Aerosil K.K. (Japan) under the trade name of Aerosil, and K.K. Tokuyama (Japan) under the trade name of QS type, etc. A number of silanol groups on the surface of the fumed silica is generally less than 5 per square nm.

In the present invention, fumed silica having an average particle size of the primary particles of 5 to 50 nm is used in the points of a printing density, transparency and glossiness, and an average particle size of the primary particles is preferably 5 to 30 nm in the points of ink absorption property, transparency and glossiness. However, when the particle size is too small, glare of the surface is likely caused by outside light.

An average particle size of the primary particle of the inorganic fine particles of the present invention is obtained from an observation by an electron microscope where the particles are dispersed sufficiently enough for the primary particle being identified, and for each of 100 particles existing in a predetermined area, a diameter of a circle whose area is equivalent to a projected area of each particle is taken as a particle diameter for that particle. For the secondary particles, too, the particles dispersed by a mild shear force are observed by an electron microscope and the average particle size thereof is calculated in the same manner.

In the present invention, a solid component per a unit area of the ink-receptive layer is generally 10 g/m$^2$ or more, preferably in the range of 13 to 35 g/m$^2$.

In the void-type ink-receptive layer of the present invention, a binder is contained for the purpose of maintaining characteristics as a film. As the binder, a hydrophilic binder is used since it has a high transparency, and a high permeability of ink can be obtained. For using the hydrophilic binder, it is important that the hydrophilic binder does not clog the voids by swelling at the initial stage of permeation of ink. In view of this point, a hydrophilic polymer having a relatively low swellability at around the room temperature is preferably used among the hydrophilic binders to be used in the swelling-type ink-receptive layer. As the hydrophilic binder, there may be mentioned, for example, polyvinyl alcohol, polyvinyl pyrrolidone, polyacrylamide, polyethylene oxide, hydroxyethyl cellulose, casein, etc., or a modified product thereof. Of these, a particularly preferred is a completely or partially saponified polyvinyl alcohol or a cationic-modified polyvinyl alcohol.

Among the polyvinyl alcohols, particularly preferred is partially or completely saponified polyvinyl alcohol having a saponification degree of 80% or more. Polyvinyl alcohols having an average polymerization degree of 1,000 to 5,000 are preferably used.

Also, as the cationic-modified polyvinyl alcohol, there may be mentioned, for example, a polyvinyl alcohol having a primary to tertiary amino groups or a quaternary ammonium group at the main chain or side chain of the polyvinyl alcohol as disclosed in, for example, Japanese Provisional Patent Publication No. 10483/1986.

Also, other hydrophilic polymer or latex may be used in combination with the polyvinyl alcohol, and an amount thereof is preferably 20% by weight or less.

In the present invention, a weight ratio of the hydrophilic binder based on the amount of the inorganic fine particles of the void-type ink-receptive layer is mainly determined by transparency, ink-absorption property and surface strength of the ink-receptive layer, and generally in the range of 5 to 35% by weight, preferably 5 to 30% by weight. When the ratio of the inorganic fine particles to the hydrophilic polymer is increased, ink-absorption property is improved but transparency is lowered and cracking at the time of drying likely occurs, surface strength is lowered and dropping of powder is likely caused. On the other hand, when the ratio is lowered, ink-absorption property is lowered and back transcription of the solvent becomes remarkable while transparency and surface strength are improved.

To prevent from back transcription of ink or to lower surface glare in which outer light is reflected on the surface of the recording material in the present invention, at least one pigment selected from an inorganic pigment and an organic solvent each having an average particle size of 0.5 μm or more, preferably 0.5 to 10 μm is used in the ink-receptive layer. For example, there may be mentioned inorganic pigments such as light calcium carbonate, heavy calcium carbonate, magnesium carbonate, kaolin, titanium dioxide, zinc oxide, zinc hydroxide, calcium silicate, magnesium silicate, synthesized silica, alumina, alumina hydrate, aluminum oxide, magnesium hydroxide and the like, and organic pigments such as polystyrene, polyethylene, polyacrylate, polymethacrylate, polyvinyl chloride, urea resin, and the like. Preferably, synthesized silica and particularly silica prepared by the wet process is selected since it has an effect of improving the ink-absorption property and lowering surface glare. When the average particle size is smaller than 0.5 μm, there cannot be expected to obtain an effect of lowering the back light due to reflection. Preferably, the average particle size is larger than 1 μm to lower the surface glare and to prevent back transcription of ink. The average particle size is preferably 10 μm or less in the points of surface smoothness by touching with hands or image sharpness. A content of the inorganic pigment or the organic pigment with the average particle size of 0.5 μm or more is generally 0.01 to 3 g/m$^2$ or so in a unit surface area of the recording material, preferably 0.01 to 2 g/m$^2$. If it is contained in an amount less than 0.01 g/m$^2$, an improvement effect of preventing glare is little, while if it exceeds 3 g/m$^2$, transparency or feeling by touching with hands is likely lowered. Incidentally, in the present invention, the average particle size of 0.5 μm or more means that either of the primary particle or the secondary particle may be 0.5 μm or more.

In the present invention, avoid ratio of the back coating layer is 70% by volume or less and the inorganic fine particles having an average particle size of the primary particles of 5 to 50 nm are used, whereby back transcription of the solvent can be inhibited and paper feeding and conveying property can be improved. The void ratio can be regulated to 70% by volume or less by selecting a kind and a ratio of the inorganic fine particles and the hydrophilic binder. The inorganic fine particles to be used can be selected from the inorganic fine particles to be used in the ink-receptive layer, and a wet type silica having 5 or more silanol groups per nm$^2$ is preferred and colloidal silica is particularly preferred.

The binder to be used in the back coating layer of the present invention may include, for example, a polymer such as an acrylonitrile-butadiene copolymer, an acrylate and/or methacrylate copolymer, a vinyl acetate copolymer, a styrene-butadiene copolymer, and the like; a derivative thereof; and a hydrophilic binder which is the same to be used in the ink-receptive layer, and preferably polyvinyl alcohol or a modified product thereof is used in the point of back transcription of the solvent.

A ratio of the binder to the inorganic fine particles in the back coating layer of the present invention is generally 10 to 150% by weight, and preferably 10 to 80% by weight. If it is more than 150% by weight, printing paper feeding and conveying property is poor, while if it is less than 10% by weight, layer strength is markedly lowered.

To the back coating layer of the present invention, the similar inorganic pigment or organic pigment having an average particle size of 0.5 to 10 μm which are to be preferably added to the ink-receptive layer may be added for the purpose of reducing surface glare, whereby printing paper feeding and conveying property can be improved and back transcription of ink can be prevented. However, if an amount thereof is too excessive, scratches are likely caused in the back coating layer or in the ink-receptive layer, so that the amount thereof is preferably 1 g/m$^2$ or less. In the point of back transcription of the solvent, an organic pigment is particularly preferred.

A solid content of the back coating layer per a unit surface area of the present invention is generally 0.5 to 15 g/m$^2$, preferably 1 to 10 g/m$^2$. A ratio of the inorganic fine particles to the binder, and the solid content thereof are determined depending on a curling property of the resulting recording material.

The void ratio of the back coating layer of the present invention is a ratio of a void volume which is a value subtracting a total volume of the solid component such as the inorganic fine particles and the binder in the layer from the volume calculated from a dried film thickness of the back coating layer, to the total volume of the solid component. In the present invention, the value is 70% by volume or less, preferably 65% by volume or less. If the void ratio is more than 70% by volume, a solvent of ink is likely permeated or adsorbed whereby the back transcription of the solvent becomes significant which is not preferred.

In the present invention, it is preferred that the ink-receptive layer comprises two or more layers, and an ink-receptive layer (A) near to the light transmitting support contains fumed silica having an average particle size of a primary particle of 10 to 30 nm and a hydrophilic binder and an ink-receptive layer (B) far from the light transmitting support contains alumina or alumina hydrate having an average particle size of a primary particle of 5 to 30 nm and a hydrophilic binder, in the points of a printing density and an ink absorption property.

When a ratio (C) of the hydrophilic binder to the fumed silica in the ink-receptive layer (A) is 5 to 20% by weight, a ratio (D) of the hydrophilic binder to the alumina or alumina hydrate of the ink-receptive layer (B) is 6 to 22% by weight and (C) is smaller than (D), an ink absorption property and back transcription of the solvent become good, so that the above constitution is preferred in the present invention.

In the ink to be used for ink-jet recording, there are a solvent type ink and an aqueous ink. In the solvent type ink, a colorant is formulated into a solvent such as an alcohol, a ketone, an ether, etc., while in the aqueous ink, an anionic colorant or cationic colorant, etc., is formulated into water and a water-soluble organic solvent such as methanol, ethanol, butanol, ethylene glycol, etc.

The reasons why the back transcription of ink is prevented in the present invention are that a space exists between a printed image surface of an ink-receptive layer at the front surface and a back coating layer surface by adding the inorganic fine particles to the back coating layer, and the space is further broadened by adding an inorganic pigment having an average particle size of 0.5 μm or more to the ink-receptive layer for the purpose of decreasing glare, and preferably adding an organic pigment or an inorganic pigment having an average particle size of 0.5 μm or more to the back coating layer as a preferred embodiment. The reasons why the back transcription of the solvent is prevented are that, by the same reasons as that the back transcription of ink is prevented, there exists spaces between the printed image surface and the back coating layer surface, so that a volatilized solvent is easily evaporated, and extremely fine inorganic particles, preferably colloidal silica are used in the back coating layer which becomes a dense layer structure with a void ratio of 70% by volume or less, so that volatilized solvent of ink is difficultly adsorbed or permeated. In particular, a void type material is preferred. By using fumed silica for a void type ink-receptive layer and a ratio of the hydrophilic binder is reduced, ink absorption property is heightened. Also, the solvent is diffused in the ink-receptive layer, so that direct volatilization to the surface of the image portion becomes little whereby back transcription of the solvent can be prevented and back transcription of ink can be also prevented.

In the present invention, a surfactant may be added to the ink-receptive layer for the purpose of improving coating suitability and surface property. As a cationic surfactant, there may be mentioned an aliphatic amine salt, an aliphatic quaternary ammonium salt, a benzalkonium salt, benzethonium chloride, a pyridinium salt, an imidazolium salt, etc. As an amphoteric surfactant, there may be mentioned a carboxy betaine type, anaminocarboxylate, imidazolium betaine, lecithin, etc. As a nonionic surfactant, there may be mentioned a polyoxyethylene alkyl ether, a polyoxyethylene alkyl phenyl ether, a polyoxyethylene sorbitan aliphatic acid ester, a polyethylene glycol aliphatic acid ester, a sucrose aliphatic acid ester, an aliphatic acid alkanolamide, etc. The surfactant may be used at least one selected from the above-mentioned surfactants. Also, an anionic surfactant such as a carboxylate, a sulfonate, etc., may be used, but an amount thereof is limited in the point of aggregation property of the composition for preparing an ink-receptive layer.

In the present invention, a protective layer may be further provided on the ink-receptive layer within the range which does not remarkably lower ink-absorption property and transparency. A thickness of the protective layer in general is preferably 5 μm or less.

The ink-jet recording material of the present invention preferably has a Haze value of the ink-receptive layer defined by JIS-K-7105 of 25% or less, more preferably 18% or less. When the value is higher than the above value, sharpness of the observed image is lowered, easily causing a mistake in observation especially in a medical field where a back lighting system is used.

The ink-receptive layer of the present invention preferably contains a cationic compound. As the cationic compound, there may be mentioned, for example, a cationic polymer and a water-soluble metallic compound to be used for the purpose of improving water resistance. The cationic polymer tends to deteriorate transparency when it is used in combination with fumed silica, on the other hand, the water-soluble metallic compound prevents from causing fine cracks and improves transparency. Therefore, by using admixture of two kinds of fumed silica and the water-soluble metallic compound, advantages such as improved ink-absorption property, high water resistance and high transparency can be attained.

As the cationic polymer to be used in the present invention, there may be preferably mentioned polyethyleneimine, polydiallylamine, polyallylamine, polyalkylamine, as well as polymers having a primary to tertiary amino group or a quaternary ammonium group as disclosed in Japanese Provisional Patent Publications No. 20696/1984, No. 33176/1984, No. 33177/1984, No. 155088/1984, No. 11389/1985, No. 49990/1985, No. 83882/1985, No. 109894/1985, No. 198493/1987, No. 49478/ 1988, No. 115780/1988, No.

280681/1988, No. 40371/1989, No. 234268/1994, No. 125411/1995 and No. 193776/1998, etc. An average molecular weight (Mw) of these cationic polymers is preferably 5,000 or more, more preferably in the range of 5,000 to 100,000.

An amount of these cationic polymers to be used is preferably about 1 to 10% by weight, more preferably about 2 to 7% by weight based on the amount of the inorganic fine particles.

The water-soluble metallic compound to be used in the present invention may include, for example, a water-soluble polyvalent metallic salt. As such a salt, there may be mentioned a water-soluble salt of a metal selected from the group consisting of calcium, barium, manganese, copper, cobalt, nickel, aluminum, iron, zinc, zirconium, titanium, chromium, magnesium, tungsten, and molybdenum. More specifically, such a water-soluble metallic compound may include, for example, calcium acetate, calcium chloride, calcium formate, calcium sulfate, barium acetate, barium sulfate, barium phosphate, manganese chloride, manganese acetate, manganese formate dihydrate, ammonium manganese sulfate hexahydrate, cupric chloride, copper (II) ammonium chloride dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, amide nickel sulfate tetrahydrate, aluminum sulfate, aluminum sulfite, aluminum thiosulfate, poly (aluminum chloride), aluminum nitrate nonahydrate, aluminum chloride hexahydrate, ferrous bromide, ferrous chloride, ferric chloride, ferrous sulfate, ferric sulfate, zinc phenol sulfonate, zinc bromide, zinc chloride, zinc nitrate hexahydrate, zinc sulfate, titanium chloride, titanium sulfate, zirconium acetate, zirconium chloride, zirconium oxychloride octahydrate, zirconium hydroxychloride, zirconium nitrate, basic zirconium carbonate, zirconium hydroxide, ammonium zirconium carbonate, potassium zirconium carbonate, zirconium sulfate, zirconium fluoride, chromium acetate, chromium sulfate, magnesium sulfate, magnesium chloride hexahydrate, magnesium citrate nonahydrate, sodium phosphorus wolframate, tungsten sodium citrate, dodecawolframatophosphate n hydrate, dodecawolframatosilicate 26 hydrate, molybdenum chloride, dodecamolybdatephosphate n hydrate, etc. Of these, preferred is a zirconium type compound in the point of characteristics.

Also, as the cationic compound, there may be mentioned a basic poly(aluminum hydroxide) compound which is an inorganic aluminum-containing cationic polymer. The above-mentioned basic poly(aluminum hydroxide) compound is a compound a main component of which is represented by the following formula (1), (2) or (3), and which contains a polynuclear condensed ion which is basic and a polymer in a stable form, such as $[Al_6(OH)_{15}]^{3+}$, $[Al_8(OH)_{20}]^{4+}$, $[Al_{13}(OH)_{34}]^{5+}$, $[Al_{21}(OH)_{\alpha}]^{3+}$, etc.

$$[Al_2(OH)_nCl_{6-n}]_m \quad (1)$$

$$[Al(OH)_3]_nAlCl_3 \quad (2)$$

$$Al_n(OH)_mCl_{(3n-m)} \; 0<m<3n \quad (3)$$

These compounds are commercially available from Taki Chemical, K.K., Japan under the trade name of poly(aluminum chloride) (PAC, trade name) as a water treatment agent, from Asada Chemical K.K., Japan under the trade name of poly(aluminum hydroxide) (Paho, trade name), from K.K. Riken Green, Japan under the trade name of Pyurakemu WT (trade name) and other manufacturers with the same objects whereby various kinds of different grades can be easily obtained. In the present invention, these commercially available products can be used as such, but among these, there is a material which has an excessively low pH value. In such a case, the material can be used after regulating a pH thereof optionally.

In the present invention, an amount of the above-mentioned water-soluble metallic compound in the ink-receptive layer is preferably about 0.1 g/m$^2$ to 10 g/m$^2$, more preferably about 0.2 g/m$^2$ to 5 g/m$^2$.

The above-mentioned cationic compound may be used in combination of two or more kinds. For example, the cationic polymer and the water-soluble metallic compound may be used in combination.

In the present invention, the ink-receptive layer may contain a suitable film hardening agent (cross-linking agent) to improve water resistance and dot reproducibility. Specific examples of the film hardening agent may include an aldehyde type compound such as formaldehyde and glutaraldehyde; a ketone compound such as diacetyl and chloropentanedione; bis(2-chloroethylurea)-2-hydroxy-4,6-dichloro-1,3,5-triazine, a compound having a reactive halogen as disclosed in U.S. Pat. No. 3,288,775; divinylsulfone; a compound having a reactive olefin as disclosed in U.S. Pat. No. 3,635,718; a N-methylol compound as disclosed in U.S. Pat. No. 2,732,316; an isocyanate compound as disclosed in U.S. Pat. No. 3,103,437; an aziridine compound as disclosed in U.S. Pat. No. 3,017,280 and U.S. Pat. No. 2,983,611; a carbodiimide type compound as disclosed in U.S. Pat. No. 3,100,704; an epoxy compound as disclosed in U.S. Pat. No. 3,091,537; a halogen carboxyaldehyde compound such as mucochloric acid, a dioxane derivative such as dihydroxydioxane, an inorganic film hardening agent such as chromium alum, zirconium sulfate, boric acid, borax and a borate, and they may be used singly or in combination of two or more. An amount of the hardening agent is preferably about 0.01 to about 40 g, more preferably about 0.1 to about 30 g based on 100 g of the hydrophilic binder constituting the ink-receptive layer.

In the present invention, to the ink-receptive layer, various kinds of conventionally known additives such as a coloring dye, a coloring pigment, a fixing agent of an ink dye, an UV absorber, an antioxidant, a dispersant of the pigment, an antifoaming agent, an organic solvent, a leveling agent, an antiseptic agent, a fluorescent brightener, a viscosity stabilizer, a pH controller, etc. may be added.

In the present invention, the coating method of the ink-receptive layer is not particularly limited, and a coating method conventionally known in the art may be used. For example, there may be mentioned a slide bead system, a curtain system, an extrusion system, an air knife system, a roll coating system, a rod bar coating system, etc.

When transparency or color tone of the light transmitting support is regulated, the support is prepared, for example, by formulating inorganic fine particles, etc. into a thermoplastic resin. As the inorganic fine particles, there may be utilized calcium carbonate, titanium dioxide, talc, silica or a colored pigment such as carbon black, etc. In the present invention, the support is preferably used those having opacity regulated by JIS P8138A method of 60% or less. If it is larger than 60%, light transmitting property is inferior and the resulting image becomes unclear dark one. If it is less than 5%, transmitting light is potent and the resulting image becomes difficult to see depending on the illumination of a light source. In the medical field, a blue PET film colored to a blue color is particularly preferably used.

Also, when coating solutions for forming an ink-receptive layer and for forming a back coating layer are coated on a plastic resin film support, it is generally subjected to a treatment such as a corona discharge treatment, a flame treatment, an ultraviolet rays irradiation treatment, a plasma treatment, etc., to the support before the coating.

In the present invention, it is preferred to provide a primer layer mainly comprising a natural resin or a synthetic resin on a light transmitting support such as a plastic resin film, etc. On the primer layer, coating solutions for forming an ink-receptive layer and for forming a back coating layer are coated, and after cooling, the material was dried at a relatively low temperature, so that transparency is further improved.

The above-mentioned primer layer is preferably provided with a thickness (dried film thickness) of 0.01 to 5 μm on a support, preferably in the range of 0.05 to 5 μm.

EXAMPLES

In the following, the present invention will be explained in detail by referring to Examples, but the content of the present invention is not limited by these Examples. Incidentally, in the following examples, all "part(s)" mean "part(s) by weight" of a solid component.

Example 1

A light-transmitting support shown in the following was prepared.

<Support A>

After both surfaces of a polyethylene terephthalate film having a thickness of 175 μm and colored to blue color (opacity: 15%) were subjected to corona discharge treatment, primer layers each having the following composition were provided on the both surfaces thereof with each dried film thickness of 0.3 μm.

Primer layer: A latex of vinylidene chloride:methyl acrylate:acrylic acid (90:9:1,% by weight) (weight average molecular weight: 42,000)

On the above-mentioned support was coated a coating solution for a back coating layer with the composition as mentioned below by a slide bead coating device and dried. The coating solution for a back coating layer was adjusted to a solid concentration of 12% by weight, and coating was carried out, so that a coated zamount of the solid component was 5 g/m$^2$ followed by drying. Subsequently, a coating solution for an ink-receptive layer having the following composition was so prepared that a solid concentration of 10% by weight and coated so that a coated amount of the solid component was 22 g/m$^2$ followed by drying to obtain an ink-jet recording material.

| | |
|---|---|
| <Coating solution for back coating layer> | |
| Colloidal silica (available from Nissan Chemical Industries, Ltd., average particle size of the primary particles is 15 nm, a number of silanol groups of 7 per nm$^{2)}$ | 100 parts |
| Polyvinyl alcohol (available from Kuraray Ltd., PVA117, trade name) | 20 parts |
| Polystyrene particles (available from Sekisui Kaseihin Industries, Ltd., SBX-6, trade name, average particle size: 6 μm) | 1 part |
| Boric acid | 2 parts |
| <Coating solution for ink-receptive layer> | |
| Fumed silica (average particle size of primary particles: 12 nm) | 95 parts |
| Wet process silica (available from Nippon Silica Industrial Co., Nipsil E-220A, average particle size: 2 μm) | 5 parts |

-continued

| | |
|---|---|
| Dimethyldiallyl ammonium chloride homopolymer | 3 parts |
| Boric acid | 4 parts |
| Polyvinyl alcohol (saponification degree: 88%, average polymerization degree: 3,500) | 20 parts |
| Surfactant | 1.0 part |
| Zirconium acetate | 2 parts |

Drying conditions after coating are shown below.

After the coated material was cooled at 5° C. for 30 seconds, it was dried at 45° C. and 10% RH (relative humidity) until the total solid content concentration became 90% by weight, and then, at 35° C. and 10% RH.

The thus prepared ink-jet recording material was evaluated as mentioned below. The results are shown in Table 1.

<Ink-Absorption Property>

C (cyan), M (magenta) and Y (yellow) were each printed with a single color of 100% and with a triple color of 300% by an ink-jet printer (F850, trade name, available from Cannon K.K., Japan), and immediately after the printing, PPC papers were overlapped over the printed portion with a slight pressurization, and the degree of an amount of the ink transferred to the PPC paper was observed with naked eyes and evaluated according to the following standards.

○: No transfer was observed.

Δ: Transfer was observed but practical use was possible.

X: Transfer was observed and practical use was impossible.

<Printing Density>

A printing density of the triple colored portion printed by the above-mentioned printer available from Cannon K.K. was measured by a Machbeth reflection densitometer and shown by an average value of 5-times measurements.

<Back Transcription of Ink>

The ink-jet recording material obtained in Example was printed by the above-mentioned printer available from Cannon K.K., and the printed surface was immediately overlapped with a back surface of the same recording material, and after overlapping with further 20 sheets, these sheets were allowed to stand at 40° C. for 2 hours, and then, back transcription of ink was evaluated by the following standards.

○: No back transfer of ink was observed.

Δ: Back transfer of ink was slightly observed but it is a lower limit for practical use.

X: Back transfer of ink was observed and practical use was impossible.

<Back Transcription of Solvent>

The ink-jet recording material obtained in Example was printed by the above-mentioned printer available from Cannon K.K., and the printed surface was immediately overlapped with a back surface of the same recording material, and after overlapping with further 1 sheet, these sheets were allowed to stand at 40° C. for 2 hours, and then, back transcription of the solvent was evaluated by the following standards.

◎: No back transfer of the solvent was observed.

○: Back transfer of the solvent was slightly observed.

Δ: Back transfer of the solvent was observed but it is a lower limit for practical use.

X: Back transfer of the solvent was observed and practical use was impossible.

<Paper Feeding and Conveying Property>

The recording materials obtained in Example was subjected to printing by using the above-mentioned printer available from Cannon K.K. under the conditions of at 23° C. and 55% RH, and continuous printing was carried out for 50 sheets and paper feeding and conveying property was evaluated by the following standards.

○: No multiple feeding error was observed.

Δ: Multiple feeding error was observed for 1 to 2 times.

X: Multiple feeding error was observed for 3 times or more.

<Visibility with Eyes>

The recording material obtained in Example was printed with a black image with an optical density of 1.5 to 2.5 by using the above-mentioned printer, and easiness to see was observed with naked eyes by using a schaukasten (lightening device for diagnosis) with a light source of 10,000 lux including a degree of glare by the following standards.

◎: Extremely good.

○: Good.

Δ: Slightly difficult to see but practical use is possible.

X: Difficult to see.

Example 2

An ink-jet recording material of Example 2 was obtained in the same manner as in Example 1 except for changing the ink-receptive layer of Example 1 to two layers and changing the compositions of the respective ink-receptive layers as mentioned below. Fumed silica for an ink-receptive layer A which is the lower layer was dispersed with a dimethyldiallyl ammonium chloride homopolymer, and pseudo boehmite was dispersed by a high pressure homogenizer with a solid content concentration of 21% by weight in nitric acid, and then, the coating solution for the ink-receptive layer A was so adjusted to have a solid content concentration of 12% by weight and the coating solution for the ink-receptive layer B was 10% by weight. These coating solutions were so coated that an amount of the fumed silica in the ink-receptive layer A became 16 g/m$^2$ with a solid content and an amount of the pseudo boehmite in the ink-receptive layer B became 6 g/m$^2$ with a solid content. The evaluation results are shown in Table 1.

| | |
|---|---|
| <Coating solution for ink-receptive layer A> | |
| Fumed silica | 100 parts |
| (average particle size of primary particles: 20 nm) | |
| Dimethyldiallyl ammonium chloride homopolymer | 4 parts |
| Boric acid | 4 parts |
| Polyvinyl alcohol | 10 parts |
| (saponification degree: 88%, average polymerization degree: 2,000) | |
| Basic polyaluminum hydroxide | 2 parts |
| (Pyurakemu WT, trade name, available from K.K. Riken Green) | |
| Surfactant | 0.3 part |
| Zirconium acetate | 2 parts |
| <Coating solution for ink-receptive layer B> | 100 parts |
| Pseudo boehmite | |
| (average particle size of primary particle: 15 nm, platy shape with an aspect ratio of 5) | |
| Nitric acid | 1 part |
| Boric acid | 0.3 part |
| Polyvinyl alcohol | 15 parts |
| (Saponification degree: 88%, average polymerization degree: 3,500) | |
| Surfactant | 0.3 part |
| Zirconium acetate | 2 parts |

With regard to the thus prepared ink-jet recording material, the same evaluation was carried out as in Example 1. The results are shown in Table 1.

Example 3

An ink-jet recording material of Example 3 was obtained in the same manner as in Example 2 except for changing a coating solution for an ink-receptive layer B to that as shown below. Evaluation results are shown in Table 1.

<Coating Solution for Ink-Receptive Layer B>

| | |
|---|---|
| Pseudo boehmite | 95 parts |
| (average particle size of primary particle: 15 nm, platy shape with an aspect ratio of 5) | |
| Nitric acid | 1 part |
| Wet process silica | 5 parts |
| (available from Nippon Silica Industrial Co.,Nipsil E-220A, average particle size: 2 μm) | |
| Boric acid | 0.3 part |
| Polyvinyl alcohol | 15 parts |
| (Saponification degree: 88%, average polymerization degree: 3,500) | |
| Surfactant | 0.3 part |
| Zirconium acetate | 2 parts |

Example 4

An ink-jet recording material of Example 4 was obtained in the same manner as in Example 2 except for changing a coating solution for an ink-receptive layer B to that as shown below. Evaluation results are shown in Table 1.

<Coating Solution for Ink-Receptive Layer B>

| | |
|---|---|
| <Coating solution for ink-receptive layer B> | |
| Pseudo boehmite | 97 parts |
| (average particle size of primary particle: 15 nm, platy shape with an aspect ratio of 5) | |
| Nitric acid | 1 part |
| Polystyrene particles | 3 parts |
| (available from Sekisui Kaseihin Industries, Ltd., SBX-6, average particle size: 6 μm) | |
| Boric acid | 0.3 part |
| Polyvinyl alcohol | 15 parts |
| (Saponification degree: 88%, average polymerization degree: 3,500) | |
| Surfactant | 0.3 part |
| Zirconium acetate | 2 parts |

Example 5

An ink-jet recording material of Example 5 was obtained in the same manner as in Example 1 except for changing a coating solution for a back coating layer to that as shown below. Evaluation results are shown in Table 1.

<Coating Solution for Back Coating Layer>

| | |
|---|---|
| Coating solution for back coating layer> | |
| Colloidal silica | 97 parts |
| (available from Nissan Chemical Industries, Ltd., ST-O, trade name) | |

-continued

| | |
|---|---|
| Wet process silica (available from Nippon Silica Industrial Co., Nipsil E-220A, average particle size: 2 μm) | 3 parts |
| Polyvinyl alcohol (available from Kuraray Ltd., PVA117, trade name) | 20 parts |
| Boric acid | 2 parts |

Example 6

An ink-jet recording material of Example 6 was obtained in the same manner as in Example 2 except for changing a coating solution for a back coating layer to that used in Example 5. Evaluation results are shown in Table 1.

Example 7

An ink-jet recording material of Example 7 was obtained in the same manner as in Example 1 except for changing a coating solution for an ink-receptive layer of Example 1 by removing the wet process silica and changing a coating solution for a back coating layer by removing polystyrene particles and making an amount of the colloidal silica 100 parts. Evaluation results are shown in Table 1.

Example 8

An ink-jet recording material of Example 8 was obtained in the same manner as in Example 1 except for changing a coating solution for a back coating layer to that as shown below. Evaluation results are shown in Table 1.

<Coating Solution for Back Coating Layer>

| | |
|---|---|
| <Coating solution for back coating layer> | |
| Colloidal silica (available from Nissan Chemical Industries, Ltd., average particle size of the primary particles is 15 nm, a number of silanol groups of 7 per $nm^2$) | 100 parts |

-continued

| | |
|---|---|
| Polyvinyl alcohol (available from Kuraray Ltd., PVA117, trade name) | 90 parts |
| Polystyrene particles (available from Sekisui Kaseihin Industries Co., Ltd., SBX-6, average particle size: 6 μm) | 1 part |
| Boric acid | 2 parts |

Comparative Example 1

An ink-jet recording material of Comparative example 1 was obtained in the same manner as in Example 7 except for removing the colloidal silica from the coating solution for a back coating layer of Example 7. Evaluation results are shown in Table 1.

Comparative Example 2

An ink-jet recording material of Comparative example 2 was obtained in the same manner as in Example 1 except for coating the coating solution for an ink-receptive layer of Example 1 as a coating solution for a back coating layer with the solid content coated amount of 5 $g/m^2$ and drying. Evaluation results are shown in Table 1.

Comparative Example 3

An ink-jet recording material of Comparative example 3 was obtained in the same manner as in Example 1 except for changing the coating solution for a back coating layer of Example 7 to that as shown below. Evaluation results are shown in Table 1.

<Coating Solution for Back Coating Layer>

| | |
|---|---|
| <Coating solution for back coating layer> | |
| Wet process silica (available from Nippon Silica Industrial Co., Nipsil E-220A, average particle size: 2 μm) | 100 parts |
| Polyvinyl alcohol (available from Kuraray Ltd., PVA117, trade name) | 20 parts |

TABLE 1

| | Ink absorption property | Printing density | Back transcription Ink | Back transcription Solvent | Feeding property | Visibility | Void ratio volume % of back coating layer |
|---|---|---|---|---|---|---|---|
| Example 1 | ○ | 2.19 | ○ | ○ | ○ | ◎ | 55 |
| Example 2 | ○ | 2.27 | Δ | ○ | Δ | ○ | 55 |
| Example 3 | ○ | 2.24 | ○ | ◎ | ○ | ◎ | 55 |
| Example 4 | ○ | 2.25 | ○ | ◎ | ○ | ◎ | 55 |
| Example 5 | ○ | 2.18 | ○ | Δ | ○ | ◎ | 52 |
| Example 6 | ○ | 2.26 | Δ | Δ | Δ | ○ | 52 |
| Example 7 | ○ | 2.20 | Δ | ○ | Δ | ○ | 65 |
| Example 8 | ○ | 2.22 | ○ | ◎ | Δ | ◎ | 22 |
| Comparative Example 1 | ○ | 2.18 | Δ | Δ | X | ◎ | 6 |
| Comparative Example 2 | ○ | 2.19 | X | X | X | ○ | 121 |
| Comparative Example 3 | ○ | 2.17 | Δ | X | Δ | X | 74 |

As can be seen from the results, it can be found the following. Example 2 is the case where the ink-receptive layer was made two layers and alumina hydrate was used at the upper layer, and it showed a higher printing density than that of Example 1 but no wet process silica having an average particle size of 2 μm was used, so that back transcription of ink and paper feeding and conveying property were slightly lowered. Examples 3 and 4 are the case where wet process silica having an average particle size of 2 μm and polystyrene particles having an average particle size of 6 μm were used at the upper layer of Example 2, and back transcription of ink, back transcription of the solvent and paper feeding and conveying property were markedly improved. Example 5 is the case where the polystyrene particles at the back coating layer were replaced with wet process silica having an average particle size of 2 μm in Example 1, and good properties were shown except that back transcription of the solvent was slightly lowered. Example 6 is the case where the polystyrene particles at the back coating layer were replaced with wet process silica having an average particle size of 2 μm in Example 2, and good properties were shown while back transcription of the solvent was slightly lowered. Example 7 is the case where the wet process silica in the ink-receptive layer and the polystyrene particles at the back coating layer of Example 1 were removed, and back transcription of ink and paper feeding and conveying property were slightly lowered. Example 8 in which a void ratio was reduced by changing an amount of the polyvinyl alcohol in the back coating layer to 90 parts in Example 1 showed that back transcription of the solvent was slightly improved than that of Example 1 but paper feeding and conveying property was slightly lowered. Incidentally, a degree of glare observed with naked eyes slightly lowered in Examples 2, 6 and 7 but others were good.

Comparative example 1 is the case where the colloidal silica in the back coating layer of Example 7 was removed, and in this sample, back transcription of ink was the same as that of Example 7 but paper feeding and conveying property was markedly worsened. Comparative example 2 is the case where the ink-receptive layer of Example 1 was used as the back coating layer, and in this sample, back transcriptions of ink and the solvent and paper feeding and conveying property were markedly lowered whereby it could not be used practically. Comparative example 3 is the case where the colloidal silica in the back coating layer of Example 7 was replaced with wet process silica having an average particle size of 2 μm, and in this sample, back transcription of the solvent and visibility are worsened than those of Example 1 whereby it could not be used practically.

As can be clearly seen from the above results, according to the present invention, an ink-jet recording material having high ink-absorption property and high printing density, good paper feeding and conveying property and effectively preventing back transcription, and particularly excellent in visibility even when it is used as a back-light system for a medical field can be obtained.

The invention claimed is:

1. An ink-jet recording material which comprises a light transmitting support, at least one ink-receptive layer provided on one surface of the support and at least one back-coating layer provided on the opposite surface of the support, wherein at least one of the back-coating layers contains inorganic fine particles having an average particle size of a primary particle of 5 to 50 nm and a binder, a void ratio of the layer is 70% by volume or less, and the light transmitting support has opacity regulated by JIS P8138A method of 60% or less, the ink-receptive layer comprises two or more layers, and an ink-receptive layer (A) near to the light transmitting support contains fumed silica having an average particle size of a primary particle of 10 to 30 nm and a hydrophilic binder and an ink-receptive layer (B) far from the light transmitting support contains alumina or alumina hydrate having an average particle size of a primary particle of 5 to 30 nm and a hydrophilic binder, and a weight ratio of the hydrophilic binder in the ink-receptive layer based on the amount of the inorganic fine particles is 5 to 30% by weight.

2. The ink-jet recording material according to claim 1, wherein the ink-receptive layer (B) contains at least one of an inorganic pigment and an organic pigment having an average particle size of 0.5 to 10 μm in an amount of 0.01 to 1 $g/m^2$.

3. The ink-jet recording material according to claim 1, wherein a ratio (C) of the hydrophilic binder to the fumed silica of the ink-receptive layer (A) is 5 to 20% by weight and a ratio (D) of the hydrophilic binder to the alumina or alumina hydrate of the ink-receptive layer (B) is 6 to 22% by weight and (C) is smaller than (D).

4. The ink-jet recording material according to claim 1, wherein the inorganic fine particles in the back coating layer are wet process silica having 5 or more silanol groups per square nm.

5. The ink-jet recording material according to claim 4, wherein the wet process silica in the back coating layer is colloidal silica.

6. The ink-jet recording material according to claim 1, wherein the binder in the back coating layer is polyvinyl alcohol or a modified product thereof.

7. The ink-jet recording material according to claim 1, wherein a solid content of the back coating layer is 1 to 10 $g/m^2$.

8. The ink-jet recording material according to claim 1, wherein the light transmitting support is a polyester film.

9. The ink-jet recording material according to claim 8, wherein the polyester film is a blue polyethylene terephthalate film colored to a blue color.

10. An ink-jet recording material which comprises a light transmitting support, at least one ink-receptive layer provided on one surface of the support and at least one back-coating layer provided on the opposite surface of the support, wherein at least one of the back-coating layers contains inorganic fine particles having an average particle size of a primary particle of 5 to 50 nm and a binder, a void ratio of the layer is 70% by volume or less, and the light transmitting support is a blue polyethylene terephthalate film colored to a blue color, and wherein the ink-receptive layer comprises two or more layers, and an ink-receptive layer (A) near to the light transmitting support contains fumed silica having an average particle size of a primary particle of 10 to 30 nm and a hydrophilic binder and an ink-receptive layer (B) far from the light transmitting support contains alumina or alumina hydrate having an average particle size of a primary particle of 5 to 30 nm and a hydrophilic binder.

11. The ink-jet recording material according to claim 10, wherein the ink-receptive layer contains inorganic fine particles having an average particle size of a primary particle of 5 to 30 nm and a hydrophilic binder.

12. The ink-jet recording material according to claim 10, wherein the ink-receptive layer contains at least one of an inorganic pigment and an organic pigment having an average particle size of 0.5 to 10 μm.

13. The ink-jet recording material according to claim 10, wherein the ink-receptive layer (B) contains at least one of an inorganic pigment and an organic pigment having an average particle size of 0.5 to 10 μm in an amount of 0.01 to 1 g/m$^2$.

14. The ink-jet recording material according to claim 10, wherein a ratio (C) of the hydrophilic binder to the fumed silica of the ink-receptive layer (A) is 5 to 20% by weight and a ratio (D) of the hydrophilic binder to the alumina or alumina hydrate of the ink-receptive layer (B) is 6 to 22% by weight and (C) is smaller than (D).

15. The ink-jet recording material according to claim 10, wherein the inorganic fine particles in the back coating layer are wet process silica having 5 or more silanol groups per square nm.

16. The ink-jet recording material according to claim 15, wherein the wet process silica in the back coating layer is colloidal silica.

17. The ink-jet recording material according to claim 10, wherein the binder in the back coating layer is polyvinyl alcohol or a modified product thereof.

18. The ink-jet recording material according to claim 10, wherein a solid content of the back coating layer is 1 to 10 g/m$^2$.

19. An ink-jet recording material which comprises a light transmitting support, at least one ink-receptive layer provided on one surface of the support and at least one back-coating layer provided on the opposite surface of the support, wherein at least one of the back-coating layers contains inorganic fine particles having an average particle size of a primary particle of 5 to 50 nm and a binder, a void ratio of the layer is 70% by volume or less, the ink-receptive layer comprises two or more layers, and an ink-receptive layer (A) near to the light transmitting support contains fumed silica having an average particle size of a primary particle of 10 to 30 nm and a hydrophilic binder and an ink-receptive layer (B) far from the light transmitting support contains alumina or alumina hydrate having an average particle size of a primary particle of 5 to 30 nm and a hydrophilic binder.

20. The ink-jet recording material according to claim 19, wherein the ink-receptive layer (B) contains at least one of an inorganic pigment and an organic pigment having an average particle size of 0.5 to 10 μm in an amount of 0.01 to 1 g/m$^2$.

21. The ink-jet recording material according to claim 19, wherein a ratio (C) of the hydrophilic binder to the fumed silica of the ink-receptive layer (A) is 5 to 20% by weight and a ratio (D) of the hydrophilic binder to the alumina or alumina hydrate of the ink-receptive layer (B) is 6 to 22% by weight and (C) is smaller than (D).

22. The ink-jet recording material according to claim 19, wherein the inorganic fine particles in the back coating layer are wet process silica having 5 or more silanol groups per square nm.

23. The ink-jet recording material according to claim 22, wherein the wet process silica in the back coating layer is colloidal silica.

24. The ink-jet recording material according to claim 19, wherein the binder in the back coating layer is polyvinyl alcohol or a modified product thereof.

25. The ink-jet recording material according to claim 19, wherein a solid content of the back coating layer is 1 to 10 g/m$^2$.

26. The ink-jet recording material according to claim 19, wherein the light transmitting support is a polyester film.

27. The ink-jet recording material according to claim 26, wherein the polyester film has opacity regulated by JIS P8138A method of 60% or less.

28. The ink-jet recording material according to claim 26, wherein the polyester film is a blue polyethylene terephthalate film colored to a blue color.

* * * * *